US011230872B2

(12) United States Patent
Paulsson et al.

(10) Patent No.: US 11,230,872 B2
(45) Date of Patent: Jan. 25, 2022

(54) DOOR OPERATOR

(71) Applicant: ASSA ABLOY ENTRANCE SYSTEMS AB, Landskrona (SE)

(72) Inventors: Stefan Paulsson, Odakra (SE); Sven-Gunnar Soderqvist, Vallakra (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 86 days.

(21) Appl. No.: 16/631,399

(22) PCT Filed: Aug. 2, 2018

(86) PCT No.: PCT/EP2018/070966
§ 371 (c)(1),
(2) Date: Jan. 15, 2020

(87) PCT Pub. No.: WO2019/025523
PCT Pub. Date: Feb. 7, 2019

(65) Prior Publication Data

US 2020/0217121 A1 Jul. 9, 2020

(30) Foreign Application Priority Data

Aug. 4, 2017 (SE) ..... 1730202-7

(51) Int. Cl.
*E05F 11/00* (2006.01)
*E05F 15/60* (2015.01)
(Continued)

(52) U.S. Cl.
CPC ..... *E05F 15/60* (2015.01); *E05F 15/70* (2015.01); *E05F 15/40* (2015.01); *E05Y 2400/40* (2013.01);
(Continued)

(58) Field of Classification Search
CPC ..... E05F 15/611; E05F 15/00; E05F 15/603; E05F 15/70; E05F 15/77; E05Y 2400/80;
(Continued)

(56) References Cited

U.S. PATENT DOCUMENTS 6,225,904 B1 * 5/2001 Jaffe ..... F25D 23/021 340/545.3
8,844,200 B2 * 9/2014 Yulkowski ..... E05F 15/63 49/358
(Continued)

FOREIGN PATENT DOCUMENTS

GB 2416860 2/2006
JP 2002374583 12/2002
(Continued)

OTHER PUBLICATIONS

International Search Report and Written Opinion mailed in PCT/EP2018/070966 dated Nov. 22, 2018.
Swedish Search Report mailed in 1730202-7 dated Apr. 16, 2018.

*Primary Examiner* — Chi Q Nguyen
(74) *Attorney, Agent, or Firm* — Wissing Miller LLP

(57) ABSTRACT

A door operator and a method for set-up of the door operator to operate a door leaf of a door set, with the door operator including a control unit, a drive unit, and a user interface, include the steps of receiving a set of set-up parameters for the door operator, installing the set of set-up parameters in the control unit, controlling the drive unit based on the set of set-up parameters installed in the control unit, and sending the set of set-up parameters to a remote server via a communication network for storing a backup of the set of set-up parameters on the remote server.

33 Claims, 4 Drawing Sheets

(51) Int. Cl.
*E05F 15/70* (2015.01)
*E05F 15/40* (2015.01)

(52) U.S. Cl.
CPC ..... *E05Y 2400/456* (2013.01); *E05Y 2400/66* (2013.01); *E05Y 2400/80* (2013.01); *E05Y 2900/106* (2013.01); *E05Y 2900/132* (2013.01)

(58) Field of Classification Search
CPC ..... E05Y 2400/852; E05Y 2400/00; E05Y 2900/132; E05Y 2400/30; E05Y 2400/456
USPC ..... 49/31, 13, 506; 340/5.7, 5.71
See application file for complete search history.

(56) References Cited

U.S. PATENT DOCUMENTS 10,480,236 B2 * 11/2019 Soderqvist ..... E05F 15/611
10,781,620 B2 * 9/2020 Hucker ..... E05F 1/10
2003/0033388 A1 2/2003 Hom
2008/0022596 A1 * 1/2008 Boerger ..... G08B 5/36 49/31
2008/0236048 A1 * 10/2008 Kowalczyk ..... E05F 3/224 49/280
2009/0093913 A1 * 4/2009 Copeland, II ..... E05F 1/002 700/282
2009/0122534 A1 * 5/2009 Olmsted ..... E05F 15/70 362/233
2013/0009785 A1 * 1/2013 Finn ..... G08B 7/06 340/870.01
2013/0127590 A1 5/2013 Braverman
2013/0186001 A1 7/2013 Cui
2013/0285584 A1 * 10/2013 Kim ..... H02P 29/0241 318/400.21
2015/0355828 A1 * 12/2015 Kiyomasa ..... G06F 3/04817 715/771
2017/0124011 A1 * 5/2017 Verdino ..... G06F 13/385
2017/0275938 A1 * 9/2017 Langenberg ..... E05F 15/70

FOREIGN PATENT DOCUMENTS

KR 101723595 4/2017
WO 2013052630 4/2013
WO 2015175614 11/2015

* cited by examiner

DOOR OPERATOR

This application is a 371 of PCT/EP2018/070966 filed on Aug. 2, 2018, published on Feb. 7, 2019 under publication number WO 2019/025523, which claims priority benefits from Swedish Patent Application No. 1730202-7 filed on Aug. 4, 2017, the disclosure of which is incorporated herein by reference.

FIELD OF THE INVENTION

The present invention relates to a door operator and a method for backup of door set-up parameters.

BACKGROUND OF THE INVENTION

Automatic door sets are regulated by standards such as the European standard EN16005 which defines i.e. pedestrian protection requirements for door sets. These regulations define, e.g., maximum kinetic energy, maximum closing force, opening and closing time, opening and closing time for different parts of speed trajectory of a door and use of safety sensors. These regulations were created in order to minimise the risk of injuries to any individual located in the closing path of a door leaf during closing. Many of the parameters are dependent on the surroundings of the door operator and to the door leaf and thus each door operator have to be installed and set-up on site after the door set has been mounted.

SUMMARY OF THE INVENTION

The door operator, or a part of the door operator such as a control unit, sometimes needs to be repaired or replaced. During such instances each door operator, or a part of the door operator, have to be re-installed and set-up on site again after the door operator, or a part of the door operator, has been repaired or replaced.

Sometimes settings have to be entered manually again, and sometimes it can be difficult to find the old settings and installation instructions. Repair or replacement can hence be both cumbersome, expensive and time consuming.

It is an object of the present invention to mitigate the above problems, and to provide a solution for set-up of a door operator on site in a more efficient way.

These objects are achieved by a door operator for operating a door leaf of a door set comprising a control unit, a drive unit and a user interface wherein the control unit is adapted to receive a set of set-up parameters for the door operator, and install the set of set-up parameters in the control unit to control the drive unit based on the set of set-up parameters installed in the control unit. The control unit is further adapted to send the set of set-up parameters to a remote server via a communication network for storing a backup of the set of set-up parameters on the remote server. This means that entered set-up parameters for controlling the drive unit of the door operator can be backed up in a remote server to be re-installed or re-used at a later occasion in order to facilitate maintenance and service in a cost and time efficient way.

According to an aspect the control unit is further adapted to receive a door operator location data comprising the location of the door operator and associate the set of set-up parameters with the door operator location data. The control unit is further adapted to send the set of set-up parameters associated with the door operator location data to a remote server via the communication network for storing a backup of the set of set-up parameters associated with the door operator location data on the remote server. In other words, the set-up parameters specific for the door operator at a certain geographic location is stored in the remote sever in order to find the relevant settings.

According to an aspect the control unit is further adapted to send the set of set-up parameters to a remote server via an operator terminal, connected to the door operator and the communication network, for storing a backup of the set of set-up parameters on the remote server. An operator terminal operated by e.g. service or maintenance personnel can hence be used for communication with the remote server.

According to an aspect the control unit is further adapted to send a request message to the remote server via the communication network, requesting a copy of the set of set-up parameters stored on the remote server. This means that a copy of the set-up parameters can be requested when needed.

According to an aspect the request message comprise the door operator location data. This helps finding the relevant set-up parameters for the door operator 1 at a certain geographic location.

According to an aspect the control unit is further adapted to receive, from the remote server, a copy of the set of set-up parameters stored on the remote server via the communication network. This means that previous set-up parameters can be reused.

According to an aspect the control unit is further adapted to receive, from the remote server, a copy of the set of set-up parameters stored on the remote server via an operator terminal connected to the door operator and the communication network. An operator terminal operated by e.g. service or maintenance personnel can hence be used for communication with the remote server.

According to an aspect the control unit is further adapted to receive, from the remote server, in response to the request message, a copy of the set of set-up parameters stored on the remote server via the communication network. Hence, a message requesting the settings is triggering retrieval of the set-up parameters.

According to an aspect the control unit is further adapted to receive, from the remote server in response to a command from an operator terminal, a copy of the set of set-up parameters stored on the remote server via the communication network. An operator terminal operated by e.g. service or maintenance personnel can hence be used for retrieving set-up parameters to the door operator 1.

According to an aspect the control unit is adapted to install a copy of the set of set-up parameters from the remote server. Hence the received copy of the set of set-up parameters can be used in the control unit.

According to an aspect the control unit is further adapted to delete any existing set of set-up parameters, and install the received copy of the set of set-up parameters from the remote server via the communication network. In other words, existing set of set-up parameters can be replaced with the set of set-up parameters from the remote server.

According to an aspect the control unit is further adapted to display the received copy of the set of set-up parameters from the remote server to a user via a user interface of the door operator. Set of set-up parameters can hence be in form of text, image or any visual information that an e.g. service or maintenance personnel can interpret.

According to an aspect the control unit is adapted to receive the set of set-up parameters manually entered via the user interface of the door operator. In other words, a user, e.g. service or maintenance personnel, can manually enter the set of set-up parameters via the user interface.

According to an aspect the control unit is adapted to receive the set of set-up parameters from an operator terminal connected to the door operator. In other words, an operator terminal operated by a user, e.g. service or maintenance personnel, can be used for digitally enter the set of set-up parameters e.g. by transferring software or parameter data.

According to an aspect the control unit is adapted to send the set of set-up parameters installed in the control unit. This means that the set of set-up parameters are in binary form and suitable for being processed by a machine.

According to an aspect the control unit is adapted to send the set of set-up parameters manually entered via the user interface of the door operator in form of at least on one of an image file or text file entered via an operator terminal connected to the door operator. This means that the set of set-up parameters are in form of an image or text file that is suitable for being opened using a computer and interpreted by a human such as service or maintenance personnel.

According to an aspect the set of set-up parameters comprises parameters that are dependent on the surroundings of the door leaf. Hence, the set of set-up parameters are tailor-made for the specific location of the door operator, taking the surroundings and location of the door operator in consideration.

According to an aspect the control unit is adapted to receive the set of set-up parameters provided via the user interface. In other words, the user interface can be used for entering the set of set-up parameters.

According to an aspect the control unit is connected to the drive unit and the user interface, and the drive unit comprises a motor and is adapted to be connected to the door leaf and to move it between an open and a closed position (O, C). This means that the control unit controls the door leafs with instructions carried out by the drive unit.

According to an aspect the set of set-up parameters comprises at least one of the parameters of the geometry of the door set, the geometry of the door leaf, the speed trajectory of the door leaf, a virtual spring, a power assist, a motor lock and a lock release. Hence, the set-up parameters have technical and physical effect.

According to an aspect the control unit comprise a memory unit and wherein the memory unit is configured to store said set of set-up parameters.

According to an aspect the control unit is configured to authenticate the set of set-up parameters. This means that any incorrect set-up parameter can be identified.

According to an aspect the door operator comprise a Universal Serial Bus port, wherein the Universal Serial Bus port is connected to the control unit and adapted to be connected to an external Universal Serial Bus memory.

According to an aspect the door operator comprise a communication device, wherein the communication device is connected to the control unit and adapted to establish a communication with an external communication device.

According to an aspect the user interface comprises one or more of a touch screen, a potentiometer, a dip switch and/or a set of buttons. This means that the set of set-up parameters can e.g. be manually entered by service or maintenance personnel via input on the touch screen or settings of e.g. dip switches.

Objects of the invention are further achieved by a method for set-up of a door operator for operating a door leaf of a door set comprising a control unit, a drive unit and a user interface. The method comprising receiving a set of set-up parameters for the door operator, where the set of set-up parameters comprises parameters that are dependent on the surroundings of the door leaf. This is followed by installing the set of set-up parameters in the control unit, controlling the drive unit based on the set of set-up parameters installed in the control unit and sending the set of set-up parameters to a remote server via a communication network for storing a backup of the set of set-up parameters on the remote server. This means that entered set-up parameters for controlling the drive unit of the door operator can be backed up in a remote server to be re-installed or re-used at a later occasion in order to facilitate maintenance and service in a cost and time efficient way.

According to an aspect the method further comprising receiving a door operator location data comprising the location of the door operator and associating the set of set-up parameters with the door operator location data. This is followed by sending the set of set-up parameters associated with the door operator location data to the remote server via the communication network for storing a backup of the set of set-up parameters associated with the door operator location data on the remote server. In other words, the set-up parameters specific for the door operator at a certain geographic location is stored in the remote server in order to find the relevant settings.

According to an aspect the method further comprising sending the set of set-up parameters to a remote server via an operator terminal connected to the door operator and the communication network, for storing a backup of the set of set-up parameters on the remote server. An operator terminal operated by e.g. service or maintenance personnel can hence be used for communication with the remote server.

According to an aspect the method further comprising sending a request message to the remote server via the communication network, requesting a copy of the set of set-up parameters stored on the remote server. This means that the copy of the set-up parameters can be requested when needed.

According to an aspect the request message comprise the door operator location data. This helps finding the relevant set-up parameters for the door operator at a certain geographic location.

According to an aspect the method further comprising receiving from the remote server, the copy of the set of set-up parameters stored on the remote server via the communication network. This means that previous set-up parameters can be reused.

According to an aspect the control unit is adapted to install the received copy of the set of set-up parameters from the remote server. Hence the received copy of the set of set-up parameters can be used in the control unit.

According to an aspect the method further comprising deleting any existing set of set-up parameters, and installing the received copy of the set of set-up parameters from the remote server via the communication network. In other words, existing set of set-up parameters can be replaced with the set of set-up parameters from the remote server.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments and aspects.

DETAILED DESCRIPTION

Aspects of the present invention will be described more fully hereinafter with reference to the accompanying figures. The assembly and method disclosed herein can, however, be realized in many different forms and should not be construed as being limited to the aspects set forth herein.

The terminology used herein is for the purpose of describing particular aspects of the invention only, and is not intended to limit the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The present invention relates to door operators for different types of door sets and door leafs. More specifically, the invention relates to door operators for any type of door, a sliding door, a sectional door, a high speed door, a gate or barrier obstructing passage, such as a revolving door, a swing door, a hinged door, an up and over door, a roll door, a garage door, an industrial door, a gate, a barrier, an or any device having the same function as a door. For visualization and for exemplifying the invention, the figures are provided that discloses a swing door set and a sliding door set.

In FIGS. 1 to 4 a door operator 1 is disclosed that is connected to a door leaf 2 of a swing door set 3 and adapted to move the door leaf 2 from an open position O to a closed position C and from a closed position C to an open position O.

Figure 5:
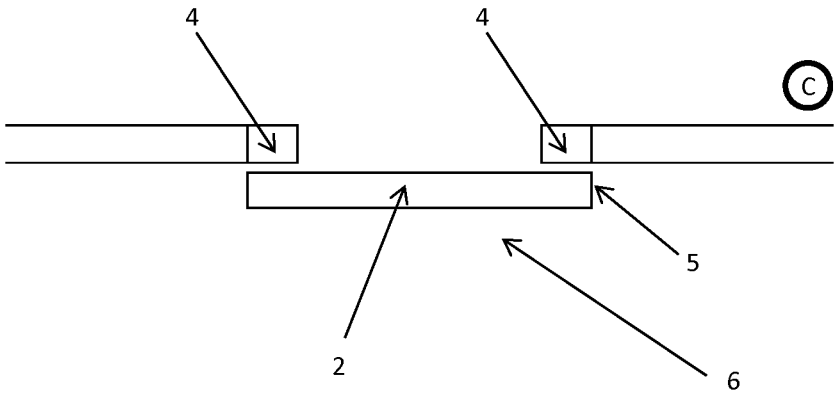
FIG. 5 shows a schematic top view of a sliding door with one door leaf, wherein the door leaf is arranged in a closed position.
Figure 6:
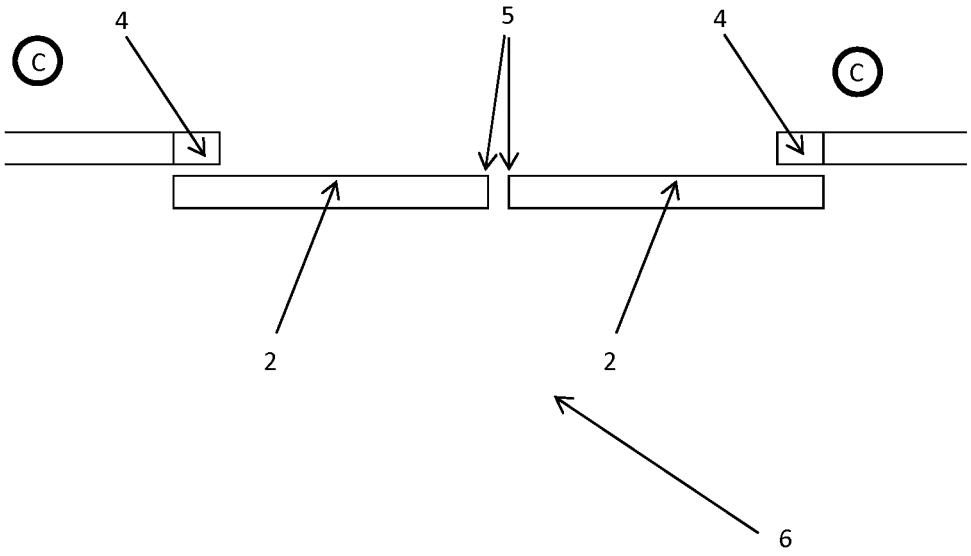
FIG. 6 shows a schematic top view of a sliding door with two door leafs, wherein the two door leafs are arranged in a closed position.

In FIGS. 5 and 6 a sliding door set 6 is disclosed that is adapted to be connected to a door operator 1.

Figure 7:
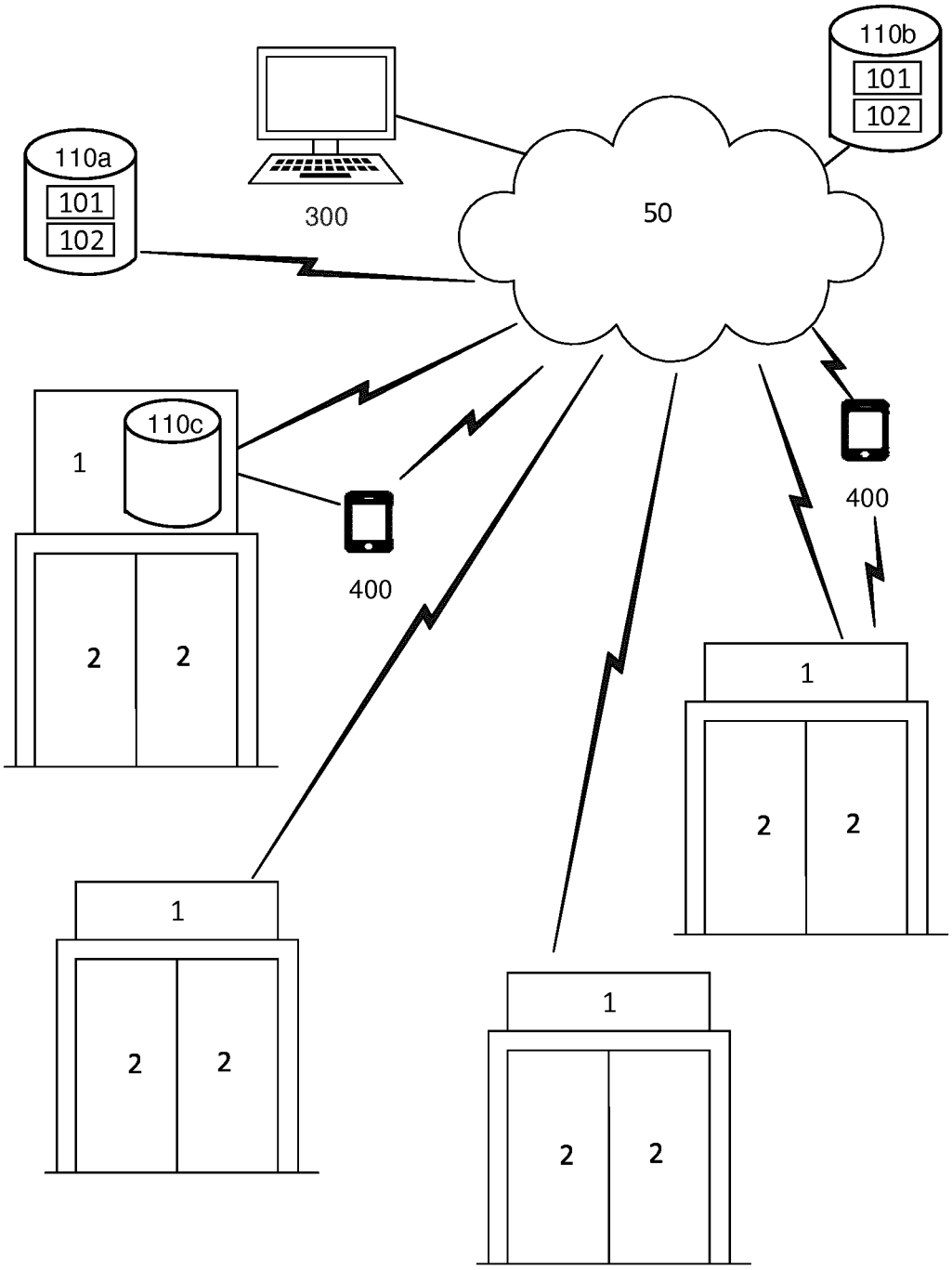
FIG. 7 shows a system view of door operators connected to remote servers via a communication network.

In FIG. 7 discloses door operators 1 connected to remote servers 110*a*, 110*b*, 110C via a communication network 50.

A revolving door set generally refers to a door set having one or more door leafs that rotate about an axel.

A swing door set generally refers to a door set having one or two door leafs 2, i.e. a single leaf swing door set 3 or a double leaf swing door set 3, where each swing door leaf is hinged or pivoted to the door frame at one of its edges.

When the swing door set 3 is provided with only one door leaf 2, the swing door leaf 1 is hinged or pivoted at one edge to the door frame 4, while the main opening/closing edge 5 of the door leaf 2 closes against, and preferably locks with, the corresponding edge of the door frame 4.

When the swing door set 3 is provided with two swing door leafs 2, the swing door set 3 may comprise two identical swing door leafs 2*a, b*, arranged side by side with their respective opening/closing edges 3 in close proximity to each other when both door leafs 2 *a, b* are in the closed position C.

Also, the swing door set 3 may comprise a master swing door leaf 2*a*, provided with a flange extending along its main opening/closing edge 3, and a slave door leaf 2*b*. The flange of the master door leaf 2*a* is adapted to protrude over the main opening/closing edge 3 of the slave door leaf 2*b*, when both door leafs 2*a*, 2*b* are in the closed position C. With such an arrangement, the door leafs 2 *a*, 2*b* can be pushed open in one direction only, preferably from the inside of a room or building in a direction outwards towards the exterior, a corridor, or an evacuation route. The main opening/closing edge 3 of the master door leaf 2*a* closes against, and preferably locks into, an opposing opening/closing edge, i.e. the main opening/closing edge 5, of the slave door leaf 2*b*.

Correspondingly, a sliding door set 6 generally refers to a sliding door set 6 having one or two door leafs 2, i.e. a single leaf sliding door set or a double leaf sliding door set, where each door leaf 2 hangs from, and slides along, a rail arranged in parallel with the upper horizontal edge of the door frame 4. Each sliding door leaf 2 has a main opening/closing edge 5, whose distance from an opposing edge, which refers to either an edge formed by the main opening/closing edge 3 of a counter closing door leaf 2, or a fixed edge or a surface towards which the door leaf 2 is moving, such as a door frame 4, determines the usable opening of the sliding door set 6.

When the sliding door set 6 is provided with only one door leaf 2, the main opening/closing edge 5 of the door leaf 2 closes against, and preferably locks with, an edge of the door frame 2.

When the sliding door set 6 is provided with two sliding door leafs 2*a*, 2*b*, the main opening/closing edge 3 of the first door leaf 2*a* closes against, and preferably locks with, the corresponding edge of a second door leaf 2*b*.

In a swing door set 3, the open position O means that the door leaf 2 is opened to an angle $\alpha$ of approximately 80-110° in relation to the surrounding walls, which is a common door opening angle during regular use. The closed position C means that the swing door leaf is arranged at a 0° angle, i.e. the door opening is completely closed by the door leaf 2.

In a sliding door set 6, the open position O means that the door leaf 2 is arranged in one of its end positions, i.e. the end position wherein the door opening is open. The closed position C means that the opening/closing edge 5 of the door leaf 2 is arranged at the edge which it closes against, i.e. the door opening is completely closed. By "edge" is meant one side of a door frame or the opening/closing edge of a further sliding door leaf 2.

Figure 1:
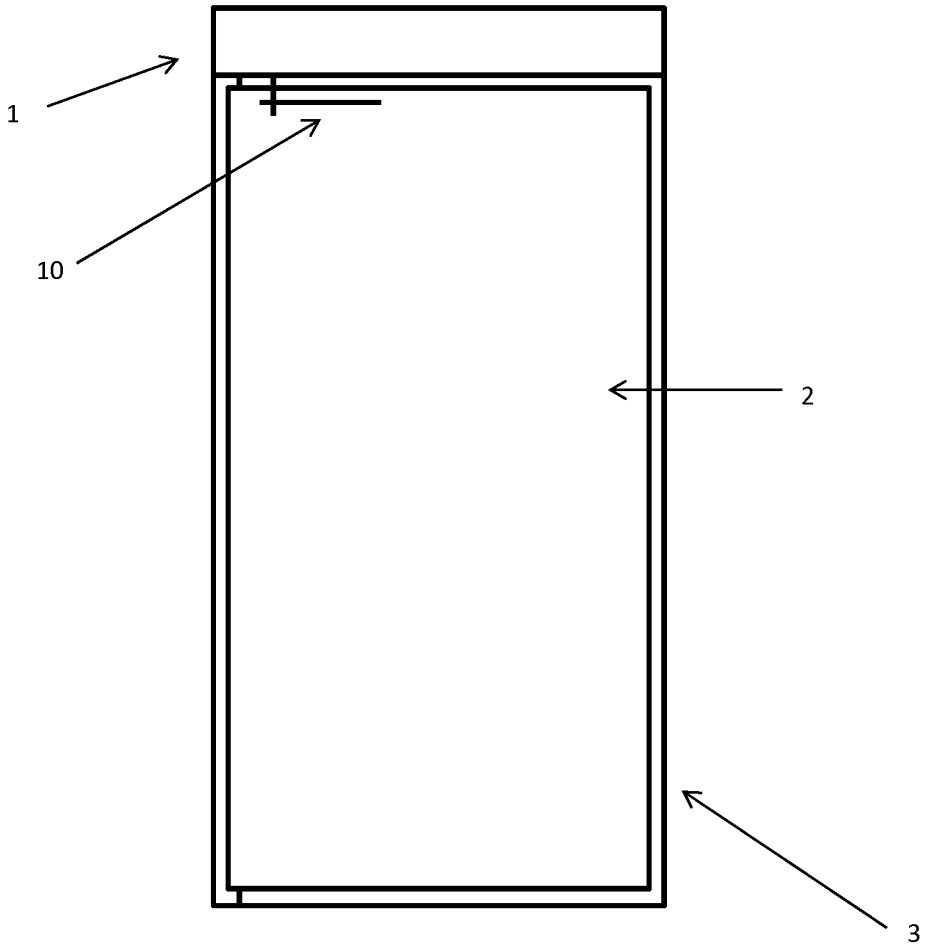
FIG. 1 show a door operator connected to a swing door.

A sliding door set 6 comprises at least one door leaf 2 and at least one door operator 1. The sliding door set 6 preferably comprises one of the following combinations: one door leaf 2 and one door operator 1, as shown in FIGS. 1 and 5, two sliding door leafs 2*a, b* and one door operator 1, operating both sliding door leaves 2*a, b*, or two sliding door leafs 2*a, b* and two door operators 1, each sliding door leaf 2*a, b* being connected to its own door operator 1. Aspects comprising two sliding door leafs 2*a, b* are shown in FIG. 6.

Figure 4:
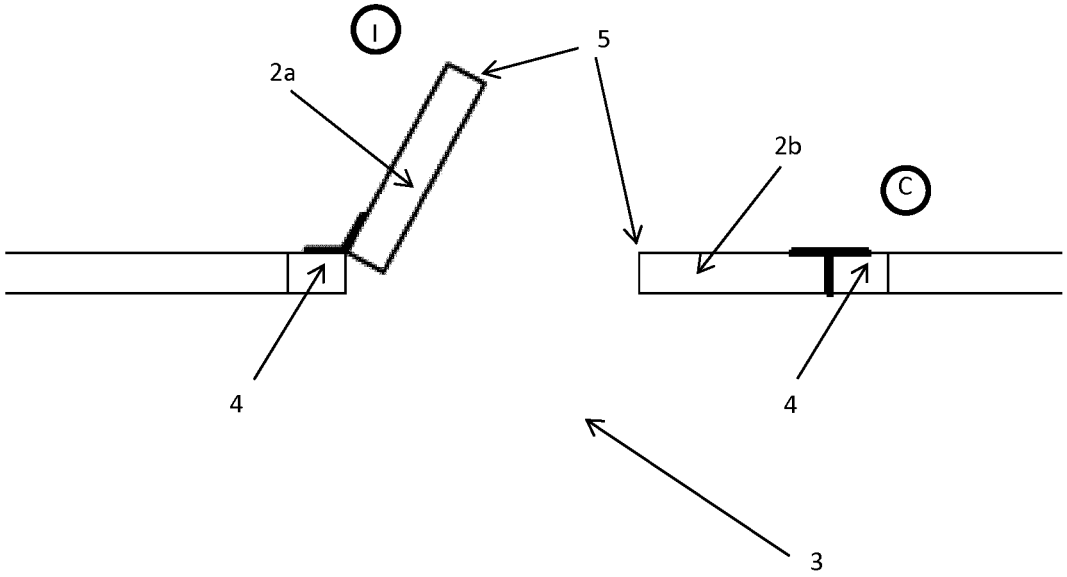
FIG. 4 shows a schematic top view of a swing door with two door leafs, wherein one door leaf is arranged in an intermediate position and one door leaf is arranged in a closed position.

A swing door set 3 comprises at least one door leaf 2 and at least one door operator 1. The swing door set 3 preferably comprises one of the following combinations: one door leaf 2 and one door operator 1, as shown in FIG. 1, or two swing door leafs 2*a*, 1*b* and two door operators 1, each door leaf 2*a*, 2*b* being connected to its own door operator 1, as shown in FIG. 4.

The door operator 1 is connected to the door leaf 2 and moves the door leaf 2 from its open position O to its closed position C and from its closed position C to its open position O.

Figure 2:
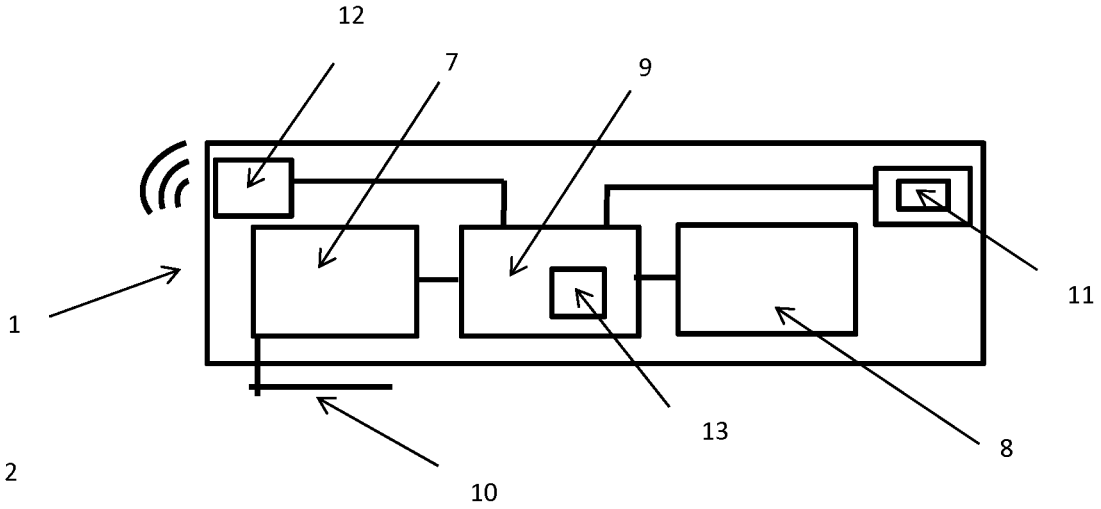
FIG. 2 shows a schematic view of a door operator.
Figure 3:
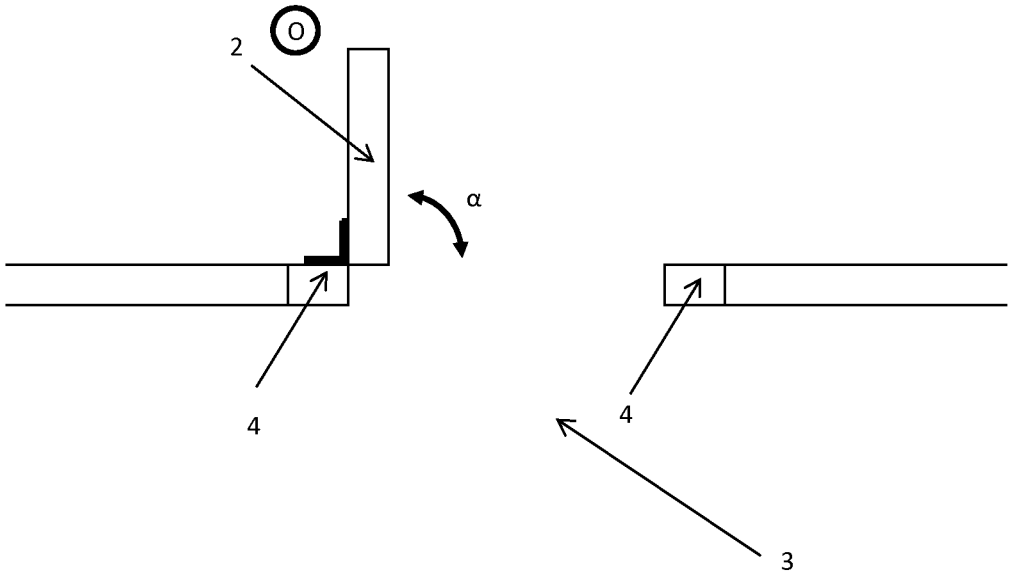
FIG. 3 shows a schematic top view of a swing door with one door leaf, wherein the door leaf is arranged in an open position.

In FIGS. 1 and 2 a door operator 1 is disclosed that comprise a drive unit 7, a user interface 8 and a control unit 9. The door operator 1 is connected to a door leaf 2 of a swing door set 3 and adapted to move the door leaf 2 from an open position O to a closed position C and from a closed position C to an open position O. The door operator further comprise a data port 11, a communication device 13.

The drive unit 7 comprises a motor. The drive unit 7 can also comprise a gear box, one or more cams and cam functions and one or more springs and spring functions. The drive unit 7 is connected to the control unit 9. The drive unit 7 is connected to a power source and the value of the current applied to the drive unit 7 from the power source is controlled by the control unit 9. The drive unit 7 is connected to the door leaf 2 by a lever 10. The drive unit 7 is connected to one end of the lever 10 and the door leaf 2 is connected to a second end of the lever 10. The type of connection between the drive unit 7 and the door leaf 2 is dependent on the type of the door set 3, 6 and the door operator 1 and is well known in the art of door operators 1. Thus, the specific features of the connection between the door operator 1 and the door leaf 2 is not described in detail in this application.

The drive unit 7 accelerates when a positive current is applied to the motor. The drive unit 7 is braked when a negative current is applied to the motor. However, the drive unit 7 can also be installed such that is accelerated when a negative current is applied to the motor and braked when a positive current is applied to the motor. The drive unit 7 moves the door leaf 2 in relation to the current that is applied to the drive unit 7.

The user interface 8 is connected to the control unit 9 and configured to send input received at the user interface 8 to the control unit 9. An input that can be received via the user interface is parameters of the first speed trajectory or input of a first or a second mode of set-up of the control unit 9. The user interface 8 can comprise a display and be configured to receive input from the control unit 9 and to display the input. The user interface 8 can comprise switches, a touch screen, dip switches, potentiometers, buttons, a data port such as a USB-port or any combination thereof. The user interface 8 can according to an aspect be connected to the control unit 9 via a wireless connection.

The user interface 8 can according to an aspect be remote from the control unit 9. The control unit 9 is connected to the user interface 8 and the drive unit 7. The control unit 9 comprises a memory unit 13 and a central processing unit. The control unit 9 is configured to control the applied current to the drive unit 7. The control unit 9 is configured to control the value of the current applied to the drive unit 7. The control unit 9 is configured to control the value of the current applied at different times during the first speed trajectory to the drive unit 7. The control unit 9 is configured to receive information and data received at the user interface 8. The control unit 9 is connected to a data port 11 and to a communication device 12.

The control unit 9 as such is well known in the art of door operators 1. Thus, the specific features of the connection between the control unit 9, the drive unit 7 and the user interface 8 are not described in detail in this application.

The data port 11 is connected to the control unit 9. The data port 11 is adapted to be connected to an external device and exchange data via the data port 11. According to an aspect, the data port 11 is a Universal Serial Bus port 11. The Universal Serial Bus port 11 could be connected to an external Universal Serial Bus memory. When a data plug is inserted in the data port 11, the data plug is detected and information of the detected data plug is sent to the control unit 9.

The communication device 12 is connected to the control unit 9. The communication device 12 is configured to send and receive electronic signals.

The communication device 12 may comprise any number of transceiving, receiving, and/or transmitting units or circuitry. The communication device 12 may be in the form of any input/output communications port known in the art. According to an aspect the communication device 12 is a wireless communication device. The wireless communication device may comprise a radio frequency circuitry and a baseband processing circuitry. The communication device 12 may hence support either wireless and/or wired communication.

The communication device 12 is adapted for communication via a communication network 50. In one example the communication network 50 is a standardized wireless local area network such as a Wireless Local Area Network, WLAN, Bluetooth™, ZigBee, Ultra-Wideband, Near Field Communication, NFC, Radio Frequency Identification, RFID, or similar network. In one example the communication network 50 is a standardized wireless wide area network such as a Global System for Mobile Communications, GSM, Extended GSM, General Packet Radio Service, GPRS, Enhanced Data Rates for GSM Evolution, EDGE, Wideband Code Division Multiple Access, WCDMA, Long Term Evolution, LTE, Narrowband-IoT, 5G, Worldwide Interoperability for Microwave Access, WiMAX or Ultra Mobile Broadband, UMB or similar network. The communication network 50 can also be a combination of both a local area network and a wide area network. The communication network 50 can also be a wired network. According to an aspect the communication network 50 is defined by common Internet Protocols.

FIG. 7 illustrates an exemplary system according an aspect of the invention. The system comprises a remote server 110*a*, 110*b*, 110*c*. The remote server 110*a*, 110*b*, 110*c* comprising a memory 101 and a processing circuitry 102. The memory 101 can be a Random-access Memory, RAM; a Flash memory; a hard disk; or any storage medium that can be electrically erased and reprogrammed. The processing circuitry 102 can be a Central Processing Unit, CPU, or any processing unit carrying out instructions of a computer program or operating system. According to an aspect the remote server 110*a*, 110*b*, 110*c* is connected to a door operator 1 via the communication network 50. According to an aspect the remote server 110*a*, 110*b*, 110*c* is connected to plural door operators 1 via the communication network 50, as illustrated in FIG. 7.

According to an aspect the remote server is a database 110*c* or control unit 9 that is connected to the door operator 1 via the communication network 50. According to an aspect the remote server 110*a*, 110*b*, 110*c* is an operator terminal 300, 400, e.g. a computer or laptop, connected to the door operator 1 via the communication network 50. According to an aspect the remote server is a portable electronic device 400, e.g. a smartphone or tablet connected to the door operator 1 via the communication network 50.

The door operator 1 employs a first speed trajectory to the door leaf 2 when opening and closing the door leaf 2. The first speed trajectory are set by a number of parameters in the door operator 1 and defines how the door operator 1 moves the door leaf 2, how much and when it is accelerated, how much and when it is braked, how long time it should take to open the door leaf 2, how long time it should take to close the door leaf 2 and the angle α that the door leaf 2 should be opened to. The door operator 1 is also set-up in relation to how it should be operated in case of an emergency such as a fire. The door operator 1 is also set-up in relation to different types of systems in the building that it is mounted in.

When the door operator 1 is installed in a building there are a number of parameters that are installed in the door operator 1 in the factory when building the door operator 1, however, there are also a number of the above number of parameters that needs to be set on site when the door operator 1 are installed. The parameters that are to be set in the door operator 1 on site are defined as a set of set-up parameters. The set-up parameters are dependent of the surroundings and location at which the specific door operator 1 is installed and to the specific door leaf 2 to which it is connected. The set of set-up parameters that are dependent on the surroundings and location is set during the installation of the door operator 1 on site.

The set of set-up parameters are stored in the door operator 1. According to an aspect the set of set-up parameters are stored in the memory 13 of the control unit 9.

When a number of door sets 3, 6 are mounted and installed in a building, many of the door operators 1 are installed and set-up with the same set of set-up parameters. This is for instance the case if a number of door sets 3, 6 are mounted in the same corridor with the same type of door operator 1 and door leaf 2 or if the same type of door operator 1 and door leaf 2 are mounted in the same position on different floors.

One of the set-up parameters that are set on site are the period/value of the time that it should take for the door operator 1 to move the door leaf 2 from its open position O to its closed position C and from its closed position C to its open position O.

The set of set-up parameters comprise at least one of the parameters of the geometry of the door set 3, 6, the geometry of the door leaf 2, the speed trajectory of the door leaf 2, a virtual spring, a power assist, a motor lock and a lock release.

According to an aspect, the control unit 9 comprise a memory unit 13 and the memory unit 13 is configured to store said set of set-up parameters.

According to an aspect, the control unit 9 is configured to authenticate the set of set-up parameters. By authenticating the set of set-up parameters the control unit 9 can get information that the set of set-up parameters comes from a correct source and are valid for the door operator 1. If the set of set-up parameters not are authenticated by the control unit 9, the set-up of the control unit 9 will be interrupted.

According to an aspect, the communication device 12 is connected to the control unit 9 and adapted to establish a communication with an external communication device.

According to an aspect, the door operator 1 comprises a communication device 12 and wherein the step of detecting an external data storage comprises the step of detecting an external communication device connected to an external data storage.

According to an aspect, the set of set-up parameters comprises at least one of the parameters of the geometry of the door set 3, 6, the geometry of the door leaf 2, the speed trajectory of the door leaf 2, a virtual spring, a power assist, a motor lock and a lock release According to an aspect, one of the set-up parameters that are set on site is the value of the time that it should take for the door operator 1 to move the door leaf 2 from its open position O to an intermediate position I and from the intermediate position I to the closed position C and from the closed position C to an intermediate position I and from the intermediate position I to the open position O.

According to an aspect, one of the set-up parameters that could be set is the value of the current that should be applied to the drive unit 7.

According to an aspect, one of the set-up parameters that are set is if the door operator 1 should set the first speed trajectory to be based on a value of the time that the first speed trajectory should take for moving the door leaf 2 or on a value of the current that should be applied to the drive unit 7.

The first speed trajectory is initiated, by the door operator 1, in response to a closing or opening command and is performed by the control unit 9 controlling the value of the current applied to the drive unit 7 during the opening or closing.

A closing command is performed in the control unit 1 when an individual, or other obstacle, is no longer detected in the closing path of the door, or after a predetermined time interval has passed from the time of opening the door leaf 2.

According to an aspect, the door operator 1 that is connected to a swing door set 3 is adapted to employ the first speed trajectory and a second speed trajectory when moving the door leaf 2 from the open position O to the closed position C, i.e. closing the door. The first speed trajectory comprises moving the door leaf 2 from the open position O to an intermediate position I and the second speed trajectory comprises moving the door leaf 2 from the intermediate position I to the closed position C. The first speed trajectory is initiated, by the door operator 1, in response to a closing or opening command and is performed by the control unit 9 controlling the value of the current applied to the drive unit 7 during the opening or closing. The second speed trajectory is employed after the first speed trajectory has been employed.

According to an aspect, when a closing command has been received by the door operator 1, the door leaf 2 is moved, using the first speed trajectory, from its open position O at an angle α of preferably 80-110° to the closed position C. The closed position C equals the completely closed position, i.e. a 0° angle.

According to an aspect, when a closing command has been received by the door operator 1, the door leaf 2 is moved, using the first speed trajectory, from its open position O at an angle α of preferably 80-110°, to an intermediate position I at an angle β of preferably 10°. Thereafter, the door leaf 2 is moved, using a second speed trajectory, from its intermediate position I to the closed position C. The closed position C equals the completely closed position, i.e. a 0° angle.

According to an aspect, the door set may comprise one or two door leafs 2, and the door set 3, 6 may be of the swing door type or the sliding door type. When having two door leafs 2, the first and second predetermined speed trajectories are preferably initiated simultaneously for both door leafs 2*a*, 2*b*, even though they may be initiated with some delay.

The control unit 9 is configured to control the drive unit 7 such that the door operator 1 employ the first speed trajectory to the door leaf 2. The shape and size of the first speed trajectory are dependent on a number of the set-up parameters stored in the control unit 9 or in a memory connected to the control unit 9.

According to an aspect, the set of set-up parameters comprise one or more of the time for moving the door leaf 2 from the closed position C to the open position O, the time for moving the door leaf 2 from the open position O to the closed position C, the time for moving the door leaf 2 from the closed position C to the intermediate position I, the time for moving the door leaf 2 from the open position O to the intermediate position I, the time for moving the door leaf 2 from the intermediate position I to the closed position C, the time for moving the door leaf 2 from the intermediate position I to the open position O, the value of the current applied to the drive unit 7 when employing the first speed trajectory, the value of the current applied to the drive unit 7 during different periods when employing the first speed trajectory, the period of the opening and closing that the drive unit 7 should be accelerated, the period of the opening and closing that the drive unit 7 should be braked, how much the motor should be accelerated and/or how much the motor should be braked.

The invention will be described in more detail with reference to the figures. According to an aspect FIG. 1 and FIG. 2 disclose a door operator 1 for operating a door leaf 2 of a door set 3, 6 comprising a control unit 9, a drive unit 7 and a user interface 8 wherein the control unit 9 is adapted to receive a set of set-up parameters for the door operator 1. According to an aspect the set of set-up parameters can be received at the control unit 9 by entering the set of set-up parameters manually or automatically. According to an aspect, the control unit 9 is adapted to receive the set of set-up parameters manually entered via the user interface 8 of the door operator 1. According to an aspect the control unit 9 is adapted to receive the set of set-up parameters from an operator terminal 300, 400 connected to the door operator 1. According to an aspect the control unit 9 is adapted to receive the set of set-up parameters from a remote server 110*a*, 110*b*, 110*c* connected to the door operator 1.

The control unit 9 is further adapted to install the set of set-up parameters in the control unit 9 to control the drive unit 7 based on the set of set-up parameters installed in the control unit 9. The control unit 9 is further adapted to send the set of set-up parameters to the remote server 110*a*, 110*b*, 110*c* via a communication network 50 for storing a backup of the set of set-up parameters on the remote server 110*a*, 110*b*, 110*c* as visualized in the example system in FIG. 7. This means that entered set of set-up parameters for controlling the drive unit 7 of the door operator 1 can be backed up in a remote server 110*a*, 110*b*, 110*c* to be re-installed or re-used at a later occasion in order to facilitate maintenance and service in a cost and time efficient manner.

According to an aspect the set of set-up parameters is entered in a remote server 110*a*, 110*b*, 110*c*. According to an aspect set of set-up parameters is manually entered in a remote server 110*a*, 110*b*, 110*c* via an operator terminal 300, 400 and being associated with a certain door operator 1 belonging to a certain door operator customer.

According to an aspect the control unit 9 is further adapted to receive a door operator location data comprising the location of the door operator 1 and associate the set of set-up parameters with the door operator location data. The door operator location data can be received at the control unit by entering the door operator location data manually or automatically. According to an aspect the control unit 9 is adapted to receive the door operator location data manually entered via the user interface 8 of the door operator 1. According to an aspect the control unit 9 is adapted to receive a door operator location data from an operator terminal 300, 400 connected to the door operator. According to an aspect the control unit 9 is adapted to receive a door operator location data from a remote server 110*a*, 110*b*, 110*c* connected to the door operator 1.

When replacing a door operator of an entrance system, the new automatic door operator is thus "paired" with the location and the door frame and/or door so as to map the entrance system to the remote server. By means of the door operator receiving and sending back set up parameters associated with the door operator location data the door operator and the corresponding set-up parameters may be stored on the remote server. Accordingly, a door operator which enables identification of the correct door system and the storing of set-up parameters of the same is achieved without requiring manual set-up.

According to an aspect the door operator location data is automatically generated with Global Position System data detected by a Global Position System receiver connected to the door operator 1. The door operator location data can be received during set-up of the door. According to an aspect the door operator location data is a location in a building or a door set position in a building. According to an aspect the door operator location data is associated with a door set identification data such as an identification number of a specific door set. According to an aspect the door operator location data can be determined by utilizing a lookup table where the door set identification data is corresponding to a certain door operator location data. According to an aspect the door operator location data is received from a remote server 110*a*, 110*b*, 110*c* comprising door operator customer information data such as the door set identification data associated with the door operator location data. According to an aspect the door set identification data is read out from an identification code, number, text, barcode, icon, QR-code or similar that is available on the specific door set that is being used for determining the door operator location data.

The control unit 9 is further adapted to send the set of set-up parameters associated with the door operator location data to the remote server 110*a*, 110*b*, 110*c* via the communication network 50 for storing a backup of the set of set-up parameters associated with the door operator location data on the remote server 110*a*, 110*b*, 110*c*. In other words, the set-up parameters specific for the door operator 1 at a certain geographic location is stored in the remote sever in order to find the relevant settings. In one example the set of set-up parameters are tagged with the door operator location data. In one example the door operator location data is entered in a remote server 110*a*, 110*b*, 110*c*. In one example the door operator location data is manually entered in a remote server 110*a*, 110*b*, 110*c* via an operator terminal 300, 400 and being associated with a certain door operator 1 belonging to a certain door operator customer. In one example the set of set-up parameters are associated in a look up table together with the door operator location data.

Thus, the door operator may automatically access the specific set-up parameters suitable for the intended entrance system by means of the stored set-up parameters, i.e. backup, of the previous automatic door operator implemented in the same entrance system.

Further this enables setting up of generic door operators in a less complex and more cost-efficient manner. Generic door operators are herein defined as door operators without pre-configured identification data associated with the set-up parameters and the door system wherein the door operator is intended to be implemented.

The setup of the generic door operator may be performed without manually assigning extensive identification data or manually selecting set-up parameters for the door operator from a database. This is enabled due to the data associated with the identification of the door operator and associated set-up parameters may be received externally by means of the location data indicating the relevant set-up parameters for the door system wherein the generic door operator is to be implemented. This may reduce the cost and time required for setting up the door operator.

According to an aspect the control unit 9 is further adapted to send the set of set-up parameters to a remote server 110*a*, 110*b*, 110*c* via an operator terminal 400, connected to the door operator 1 and the communication network 50, for storing a backup of the set of set-up parameters on the remote server 110*a*, 110*b*, 110*c*. An operator terminal 400 operated by e.g. service or maintenance personnel can hence be used for communication with the remote server 110*a*, 110*b*, 110*c*. The operator terminal 400 is in one example connected to the door operator 1 via cable, and connected to the communication network via a wireless cellular network. In one example the operator terminal 400 is connected to the door operator 1 via a wireless local area network and to the communication network 50 via a wireless wide area network.

According to an aspect the control unit 9 is further adapted to send a request message to the a remote server 110*a*, 110*b*, 110*c* via the communication network, requesting a copy of the set of set-up parameters stored on the remote server 110*a*, 110*b*, 110*c*. This means that copy of the set-up parameters can be requested when needed. In one example a request message can be sent off automatically if the door operator 1 detects an error or when the door operator, or a part of the door operator, have to be re-installed or re-started. In one example the request message is sent manually by e.g. service or maintenance personnel.

According to an aspect the request message comprise the door operator location data. This helps finding the relevant set-up parameters for the door operator 1 at a certain geographic location. In one example a user is prompted to enter the door operator location data via the user interface 8. In one example the door operator location data is automatically inserted when the request message is generated.

According to an aspect the control unit 9 is further adapted to receive, from the remote server, a copy of the set of set-up parameters stored on the remote server 110*a*, 110*b*, 110*c* via the communication network 50. The control unit 9 hence receives a copy of previously used set-up parameters for the particular door operator 1 that has been stored on the remote server 110*a*, 110*b*, 110*c*. In one example the control unit 9 is adapted to receive any exiting copy of the set of set-up parameters stored on the remote server 110*a*, 110*b*, 110*c*. In one example the latest copy of the set of set-up parameters is received by the control unit 9. This means that previous set-up parameters can be reused again and save time for service or maintenance personnel.

According to an aspect the control unit 9 is further adapted to receive, from the remote server 110*a*, 110*b*, 110*c*, a copy of the set of set-up parameters stored on the remote server 110*a*, 110*b*, 110*c* via an operator terminal 400, connected to the door operator (1) and the communication network 50. An operator terminal 400 operated by e.g. service or maintenance personnel can hence be used for communication with the remote server 110*a*, 110*b*, 110*c*. The operator terminal 400 is in one example connected to the door operator 1 via cable, and connected to the communication network via a wireless cellular network. In one example the operator terminal 400 is connected to the door operator 1 via a wireless local area network and to the communication network 50 via a wireless wide area network.

According to an aspect the control unit 9 is further adapted to receive, from the remote server 110*a*, 110*b*, 110*c* in response to the request message, a copy of the set of set-up parameters stored on the remote server 110*a*, 110*b*, 110*c* via the communication network 50. Hence, a message requesting the settings is triggering retrieval of the set-up parameters.

According to an aspect the control unit 9 is further adapted to receive, from the remote server 110*a*, 110*b*, 110*c* in response to a command from an operator terminal 300, 400, a copy of the set of set-up parameters stored on the remote server 110*a*, 110*b*, 110*c* via the communication network 50. An operator terminal 300, 400 operated by e.g. service or maintenance personnel can hence be used for retrieving set-up parameters to the door operator 1.

According to an aspect install the set of set-up parameters comprising installing the received copy of the set of set-up parameters from the remote server 110*a*, 110*b*, 110*c*. Hence the received copy of the set of set-up parameters can be used as the set-up parameters.

According to an aspect the control unit 9 is further adapted to delete any existing set of set-up parameters, and install the received copy of the set of set-up parameters from the remote server 110*a*, 110*b*, 110*c* via the communication network 50. Hence the received copy of the set of set-up parameters can replace any existing set-up parameters. In other words, existing set of set-up parameters can be replaced with the set of set-up parameters from the remote server 110*a*, 110*b*, 110*c*.

According to an aspect the control unit 9 is further adapted to display the received copy of the set of set-up parameters from the remote server 110*a*, 110*b*, 110*c* to a user via a user interface 8 of the door operator 1. Set of set-up parameters can hence be in form of text, image or any visual information that an e.g. service or maintenance personnel can interpret. In one example the set of set-up parameters is a text document with parameters described by a service or maintenance personnel during set-up of the door operator 1. In one example the set-up parameters is a displayed image of e.g. dip switch settings manually entered during set-up.

According to an aspect the control unit is adapted to receive the set of set-up parameters manually entered via the user interface of the door operator. In other words, a user, e.g. service or maintenance personnel, can manually enter the set of set-up parameters via the user interface 8.

According to an aspect the control unit is adapted to receive the set of set-up parameters from an operator terminal connected to the door operator. In other words, an operator terminal 300, 400 operated by a user, e.g. service or maintenance personnel, can be used for digitally enter the set of set-up parameters e.g. by transferring software or parameter data.

According to an aspect the control unit is adapted to send the set of set-up parameters installed in the control unit. This means that the set of set-up parameters are in binary form and suitable for being processed by a machine. This reduces the demands on the computing/encoding capability of the door operator since the door operator does not have to convert the parameters before sending said parameters to the remote server and/or after receiving said parameters from said remote server. Thus the cost of the door operator may be reduced.

According to an aspect the control unit is adapted to send the set of set-up parameters installed in the control unit without converting said set-up parameters.

According to an aspect the control unit is adapted to send the set of set-up parameters manually entered via the user interface of the door operator in form of at least on one of an image file or text file entered via an operator terminal connected to the door operator. This means that the set of set-up parameters are in form of an image or text file that is suitable for being opened using a computer and interpreted by a human such as service or maintenance personnel.

According to an aspect the set of set-up parameters comprises parameters that are dependent on the surroundings of the door leaf 2. Hence, the set of set-up parameters are tailor-made for the specific location of the door operator 1, taking the surroundings and location of the door operator 1 in consideration.

According to an aspect the control unit 9 is adapted to receive the set of set-up parameters provided via the user interface 8. In other words, the user interface can be used for entering the set of set-up parameters.

According to an aspect the control unit 9 is connected to the drive unit 7 and the user interface 8, and the drive unit 7 comprises a motor and is adapted to be connected to the door leaf 2 and to move it between an open and a closed position O, C. This means that the control unit 9 controls the door leafs with instructions carried out by the drive unit 7.

According to an aspect the set of set-up parameters comprises at least one of the parameters of the geometry of the door set 3, 6, the geometry of the door leaf 2, the speed trajectory of the door leaf 2, a virtual spring, a power assist, a motor lock and a lock release. Hence, the set-up parameters have technical and physical effect.

According to an aspect the control unit 9 comprise a memory unit 13 and means that any incorrect set-up parameter can be identified.

According to an aspect the door operator 1 comprise a Universal Serial Bus port 11, wherein the Universal Serial Bus port 11 is connected to the control unit 9 and adapted to be connected to an external Universal Serial Bus memory.

According to an aspect the door operator 1 comprise a communication device 12, wherein the communication device 12 is connected to the control unit 9 and adapted to establish a communication with an external communication device.

According to an aspect the user interface 8 comprises a touch screen, a potentiometer, a dip switch and/or a set of buttons. This means that the set of set-up parameters can e.g. be manually entered by service or maintenance personnel via input on the touch screen or settings of e.g. dip switches.

Objects of the invention are further achieved by a method for set-up of the door operator 1 for operating the door leaf 2 of the door set 3, 6 comprising the control unit 9, the drive unit 7 and the user interface 8. The method comprising receiving the set of set-up parameters for the door operator 1, where the set of set-up parameters comprises parameters that are dependent on the surroundings of the door leaf 2. The set of set-up parameters can be received at the control unit 7 by entering the set of set-up parameters manually or automatically. According to an aspect, the control unit 9 is adapted to receive the set of set-up parameters manually entered via the user interface 8 of the door operator 1. According to an aspect the control unit 9 is adapted to receive the set of set-up parameters from an operator terminal 300, 400 connected to the door operator 1. According to an aspect the control unit 9 is adapted to receive the set of set-up parameters from a remote server 110*a*, 110*b*, 110*c* connected to the door operator 1.

This is followed by installing the set of set-up parameters in the control unit 9, controlling the drive unit 7 based on the set of set-up parameters installed in the control unit 9 and sending the set of set-up parameters to the remote server 110*a*, 110*b*, 110*c* via the communication network 50 for storing a backup of the set of set-up parameters on the remote server 110*a*, 110*b*, 110*c*. This means that entered set-up parameters for controlling the drive unit 7 of the door operator 1 can be backed up in the remote server to be re-installed or re-used at a later occasion in order to facilitate maintenance and service in a cost and time efficient way.

According to an aspect the control unit 9 is further adapted to receive a door operator location data comprising the location of the door operator 1 and associate the set of set-up parameters with the door operator location data. The door operator location data can be received at the control unit by entering the door operator location data manually or automatically. According to an aspect the control unit 9 is adapted to receive the door operator location data manually entered via the user interface 8 of the door operator 1. According to an aspect the control unit 9 is adapted to receive a door operator location data from an operator terminal 300, 400 connected to the door operator. According to an aspect the control unit 9 is adapted to receive a door operator location data from a remote server 110*a*, 110*b*, 110*c* connected to the door operator 1.

According to an aspect the door operator location data is automatically generated with Global Position System data detected by a Global Position System receiver connected to the door operator 1. The door operator location data can be received during set-up of the door. According to an aspect the door operator location data is a location in a building or a door set position in a building. According to an aspect the door operator location data is associated with a door set identification data such as an identification number of a specific door set. According to an aspect the door operator location data can be determined by utilizing a lookup table where the door set identification data is corresponding to a certain door operator location data. According to an aspect the door operator location data is received from a remote server 110*a*, 110*b*, 110*c* comprising door operator customer information data such as the door set identification data associated with the door operator location data. According to an aspect the door set identification data is read out from an identification code, number, text, barcode, icon, QR-code or similar that is available on the specific door set that is being used for determining the door operator location data.

The control unit 9 is further adapted to send the set of set-up parameters associated with the door operator location data to the remote server 110*a*, 110*b*, 110*c* via the communication network 50 for storing a backup of the set of set-up parameters associated with the door operator location data on the remote server 110*a*, 110*b*, 110*c*. In other words, the set-up parameters specific for the door operator 1 at a certain geographic location is stored in the remote sever in order to find the relevant settings. In one example the set of set-up parameters are tagged with the door operator location data. In one example the door operator location data is entered in a remote server 110*a*, 110*b*, 110*c*. In one example the door operator location data is manually entered in a remote server 110*a*, 110*b*, 110*c* via an operator terminal 300, 400 and being associated with a certain door operator 1 belonging to a certain door operator customer. In one example the set of set-up parameters are associated in a look up table together with the door operator location data.

According to an aspect the control unit 9 is further adapted to send the set of set-up parameters to a remote server 110*a*, 110*b*, 110*c* via an operator terminal 400, connected to the door operator 1 and the communication network 50, for storing a backup of the set of set-up parameters on the remote server 110*a*, 110*b*, 110*c*. An operator terminal 400 operated by e.g. service or maintenance personnel can hence be used for communication with the remote server 110*a*, 110*b*, 110*c*. The operator terminal 400 is in one example connected to the door operator 1 via cable, and connected to the communication network via a wireless cellular network. In one example the operator terminal 400 is connected to the door operator 1 via a wireless local area network and to the communication network 50 via a wireless wide area network.

According to an aspect the control unit 9 is further adapted to send a request message to the a remote server 110*a*, 110*b*, 110*c* via the communication network, requesting a copy of the set of set-up parameters stored on the remote server 110*a*, 110*b*, 110*c*. This means that copy of the set-up parameters can be requested when needed. In one example a request message can be sent off automatically if the door operator 1 detects an error or when the door operator, or a part of the door operator, have to be re-installed or re-started. In one example the request message is sent manually by e.g. service or maintenance personnel.

According to an aspect the request message comprise the door operator location data. This helps finding the relevant set-up parameters for the door operator 1 at a certain geographic location. In one example a user is prompted to enter the door operator location data via the user interface 8. In one example the door operator location data is automatically inserted when the request message is generated.

According to an aspect the control unit 9 is further adapted to receive, from the remote server, a copy of the set of set-up parameters stored on the remote server 110*a*, 110*b*, 110*c* via the communication network 50. The control unit 9 hence receives a copy of previously used set-up parameters for the particular door operator 1 that has been stored on the remote server 110*a*, 110*b*, 110*c*. In one example the control unit 9 is adapted to receive any exiting copy of the set of set-up parameters stored on the remote server 110*a*, 110*b*, 110*c*. In one example the latest copy of the set of set-up parameters is received by the control unit 9. This means that previous set-up parameters can be reused again and save time for service or maintenance personnel.

According to an aspect install the set of set-up parameters comprising installing the received copy of the set of set-up parameters from the remote server 110*a*, 110*b*, 110*c*. Hence the received copy of the set of set-up parameters can be used as the set-up parameters.

According to an aspect the control unit 9 is further adapted to delete any existing set of set-up parameters, and install the received copy of the set of set-up parameters from the remote server 110*a*, 110*b*, 110*c* via the communication network 50. Hence the received copy of the set of set-up parameters can replace any existing set-up parameters. In other words, existing set of set-up parameters can be replaced with the set of set-up parameters from the remote server 110*a*, 110*b*, 110*c*.

The door operator 1 is configured to perform any of the aspects of the method described above.

The person skilled in the art realizes that the present invention by no means is limited to the preferred embodiments described above. On the contrary, many modifications and variations are possible within the scope of the appended claims. For example, a sliding door set may comprise of more than two sliding door leafs, arranged in the same way as discussed above.

In the drawings and specification, there have been disclosed exemplary aspects of the invention. However, many variations and modifications can be made to these aspects. All the different aspects of the invention can be used in any combination. Accordingly, although specific terms are employed, they are used in a generic and descriptive sense only and not for purposes of limitation, the scope of the invention being defined by the following claims.

The invention claimed is:

1. A door operator for operating a door leaf of a door set, the door operator comprising:

a control unit, a drive unit, and a user interface, wherein the control unit is adapted to:

receive a set of set-up parameters for the door operator;

install the set of set-up parameters in the control unit;

control the drive unit based on the set of set-up parameters installed in the control unit;

send the set of set-up parameters to a remote server via a communication network for storing a backup of the set of set-up parameters on the remote server;

receive a door operator location data comprising the location of the door operator; and associate the set of set-up parameters with the door operator location data.

2. The door operator according to claim 1, wherein the control unit is further adapted to:

send the set of set-up parameters associated with the door operator location data to the remote server via the communication network for storing the backup of the set of set-up parameters associated with the door operator location data on the remote server.

3. The door operator according to claim 1, wherein the control unit is further adapted to:

send the set of set-up parameters to the remote server via an operator terminal connected to the door operator and the communication network for storing the backup of the set of set-up parameters on the remote server.

4. The door operator according to claim 3, wherein the control unit is adapted to receive the set of set-up parameters from the operator terminal connected to the door operator.

5. The door operator according to claim 1, wherein the control unit is further adapted to:

send a request message to the remote server via the communication network requesting a copy of the set of set-up parameters stored on the remote server.

6. The door operator according to claim 5, wherein the request message comprises the door operator location data.

7. The door operator according to claim 5, wherein the control unit is further adapted to receive, from the remote server in response to the request message, the copy of the set of set-up parameters stored on the remote server via the communication network.

8. The door operator according to claim 1, wherein the control unit is further adapted to receive, from the remote server, the copy of the set of set-up parameters stored on the remote server via the communication network.

9. The door operator according to claim 1, wherein the control unit is further adapted to receive, from the remote server, the copy of the set of set-up parameters stored on the remote server via an operator terminal connected to the door operator and the communication network.

10. The door operator according to claim 1, wherein the control unit is further adapted to receive, from the remote server in response to a command from an operator terminal, the copy of the set of set-up parameters stored on the remote server via the communication network.

11. The door operator (1) according to claim 1, wherein the control unit is adapted to install the copy of the set of set-up parameters from the remote server.

12. The door operator according to claim 1, wherein the control unit is further adapted to:

delete any existing set of set-up parameters; and install the received copy of the set of set-up parameters from the remote server via the communication network.

13. The door operator according to claim 1, wherein the control unit is further adapted to display the received copy of the set of set-up parameters from the remote server to a user via a user interface of the door operator.

14. The door operator according to claim 1, wherein the control unit is adapted to receive the set of set-up parameters manually entered via the user interface of the door operator.

15. The door operator according to claim 1, wherein the control unit is adapted to send the set of set-up parameters installed in the control unit to the remote server via the communication network.

16. The door operator according to claim 1, wherein the control unit is adapted to send the set of set-up parameters manually entered via the user interface of the door operator in form of at least on one of an image file or text file entered via the operator terminal connected to the door operator.

17. The door operator according to claim 1, wherein the set of set-up parameters comprises parameters that are dependent on surroundings of the door leaf.

18. The door operator according to claim 1, wherein the control unit is adapted to receive the set of set-up parameters provided via the user interface.

19. The door operator according to claim 1, wherein the control unit is connected to the drive unit and the user interface, and the drive unit comprises a motor and is adapted to be connected to the door leaf and to move the door leaf between an open and a closed position.

20. The door operator according to claim 1, wherein the set of set-up parameters comprises at least one of the parameters of a geometry of the door set, a geometry of the door leaf, and a speed trajectory of the door leaf.

21. The door operator according to claim 1, wherein the control unit comprises a memory unit, and wherein the memory unit is configured to store the set of set-up parameters.

22. The door operator according to claim 1, wherein in the control unit is configured to authenticate the set of set-up parameters.

23. The door operator according to claim 1, further comprising a Universal Serial Bus port, wherein the Universal Serial Bus port is connected to the control unit and adapted to be connected to an external Universal Serial Bus memory.

24. The door operator according to claim 1, further comprising a communication device, wherein the communication device is connected to the control unit and adapted to establish a communication with an external communication device.

25. A door operator according to claim 1, wherein the user interface comprises one or more of a touch screen, a potentiometer, a dip switch, or a set of buttons.

26. A method for set-up of a door operator for operating a door leaf of a door set comprising a control unit, a drive unit, and a user interface, the method comprising:

receiving a set of set-up parameters for the door operator;

installing the set of set-up parameters in the control unit;

controlling the drive unit based on the set of set-up parameters installed in the control unit;

sending the set of set-up parameters to a remote server via a communication network for storing a backup of the set of set-up parameters on the remote server receive a door operator location data comprising the location of the door operator; and associating the set of set-up parameters with the door operator location data.

27. The method for set-up of a door operator according to claim 26 further comprising:

sending the set of set-up parameters associated with the door operator location data to a remote server via the communication network for storing a backup of the set of set-up parameters associated with the door operator location data on the remote server.

28. The method for set-up of a door operator according to claim 27 further comprising:

sending a request message to the remote server via the communication network requesting a copy of the set of set-up parameters stored on the remote server.

29. The method for set-up of a door operator according to claim 28, wherein the request message comprises the door operator location data.

30. The method for set-up of a door operator according to claim 26 further comprising:

sending the set of set-up parameters to the remote server via an operator terminal connected to the door operator and the communication network for storing a backup of the set of set-up parameters on the remote server.

31. The method for set-up of a door operator according to claim 26 further comprising:

receiving, from the remote server, the copy of the set of set-up parameters stored on the remote server via the communication network.

32. The method for set-up of a door operator according to claim 26, wherein the control unit is adapted to install the received copy of the set of set-up parameters from the remote server.

33. The method for set-up of a door operator according to claim 26 further comprising:

deleting any existing set of set-up parameters, and installing the received copy of the set of set-up parameters from the remote server via the communication network.

* * * * *